United States Patent [19]

Barker

[11] 4,246,684

[45] Jan. 27, 1981

[54] BURNISHING TOOL

[75] Inventor: Edison D. Barker, Kettering, Ohio

[73] Assignee: General Motors Corporation, Detroit, Mich.

[21] Appl. No.: 62,672

[22] Filed: Aug. 1, 1979

[51] Int. Cl.[3] ..... B21C 37/30

[52] U.S. Cl. ..... 29/90 R

[58] Field of Search ..... 29/90 R

[56] References Cited

U.S. PATENT DOCUMENTS

| | | | |
|---|---|---|---|
| 1,578,363 | 3/1926 | Radosevic . | |
| 1,585,656 | 5/1926 | Ewell et al. . | |
| 1,608,154 | 11/1926 | Anderson . | |
| 1,690,371 | 11/1928 | Koch . | |
| 2,282,550 | 5/1942 | Trerice | 29/90 R |
| 2,390,651 | 12/1945 | Iseman | 29/90 R |

FOREIGN PATENT DOCUMENTS

| | | | |
|---|---|---|---|
| 1013606 | 8/1957 | Fed. Rep. of Germany | 29/90 R |
| 224023 | 11/1924 | United Kingdom | 29/90 R |
| 833989 | 5/1960 | United Kingdom | 29/90 R |
| 1444289 | 7/1976 | United Kingdom | 29/90 R |

*Primary Examiner*—Harrison L. Hinson
*Attorney, Agent, or Firm*—D. D. McGraw

[57] ABSTRACT

The tool has a shank with a draw bolt threaded in an open recess in one end. A compression ring is mounted on the draw bolt and has an axially tapered outer peripheral surface. A burnishing ring is received about the draw bolt compression ring and axially engages the end of the tool shank. The burnishing ring has an outer diameter which is greater than the maximum outer diameter of the tool shank as well as being greater than the maximum outer diameter of the draw bolt. The burnishing ring has an inner diameter axially tapered surface which mates with the axially tapered outer peripheral surface of the compression ring. When the draw bolt is tightened it holds the compression ring tightly within the burnishing ring, thereby providing a mount for the burnishing ring. The burnishing ring has a precise desired outer diameter for burnishing a bore. The burnishing ring may be made of carbide or similar material and can be quickly removed and replaced as necessary due to wear or the requirement for a different burnishing diameter. Alternatively, the burnishing ring may be made of a material having a sufficiently high modulus so that the burnishing ring expands as the draw bolt is tightened and the compression ring is moved axially within the burnishing ring. The burnishing ring is expanded to the precise desired outer diameter for burnishing a bore, but is not expanded until it reaches the yield point. A jam nut may be provided on the draw bolt to lock the burnishing ring and the compression ring in position, the jam nut having a maximum outer diameter which is less than the maximum outer diameter of the burnishing ring.

5 Claims, 3 Drawing Figures

BURNISHING TOOL

The invention relates to a burnishing tool having a burnishing ring which may be readily removed and replaced. One of the features of the invention is to provide a burnishing ring made of carbide or similar material which can be secured tightly in position so that it may burnish a bore and yet may be readily removed and replaced to permit the use of a ring of a different diameter if needed or to replace the ring because of wear.

Another feature of the invention is the provision of a burnishing ring which is made of a material having a sufficiently high modulus so that the ring does not reach the yield point within an adjustable distance through which the draw bolt can be tightened, tightening of the draw bolt acting on the compression ring resulting in expansion of the burnishing ring to the precise desired outer diameter for burnishing a bore.

It is another feature of the invention that a jam nut may be used either with a stretchable or a non-stretchable burnishing ring as above described. The jam nut is threaded on the draw bolt and axially engages the burnishing ring to lock the burnishing ring and the compression ring in position. The jam nut has a maximum outer diameter which is less than the maximum outer diameter of the burnishing ring. When the jam nut is being used with a carbide or similar ring which is not expandable, the jam nut assists in firmly holding the burnishing ring in position for burnishing operation. When used with an expandable burnishing ring it holds the burnishing ring and compression ring in position to maintain the precise desired diameter of the burnishing ring.

A burnishing tool made in accordance with the invention will permit the use of a few number of burnishing rings to cover a wide range of diameters. A precise burnishing diameter may be readily established by adjusting the outer diameter of the burnishing ring as needed, while remaining within the elastic limit of the burnishing ring, as the burnishing ring wears. The burnishing ring may be readily removed and replaced as needed. Thus the tool can replace previously used burnishing tools of the ball or roller type. Ball burnishing tools, with each ball being precision ground tungsten carbide brased onto a drive shaft, are normally power fed into the bores to be burnished. Each tool is good for only one initial run since it is non-adjustable. This requires an assortment of ball sizes to meet the surface finish requirement, often including a series of runs with different tools. Roller burnishing tools have cylindrical tapered rollers, a tapered mandrel and a retaining cage. Such a tool rotates while feeding into the bore and acts as a heavy-preloaded bearing during the work cycle. The tool rotates from the center mandrel and drives the rollers as they engage the workpiece. The tool diameter is adjustable, but the rollers and mandrel are very perishable due to the heavy working load.

Figure 1:
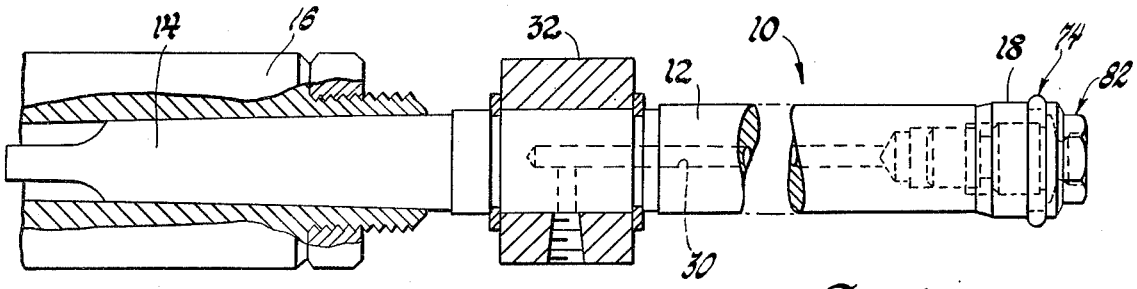
FIG. 1 is an elevation view of a burnishing tool embodying the invention, with parts broken away and in section.
Figure 2:
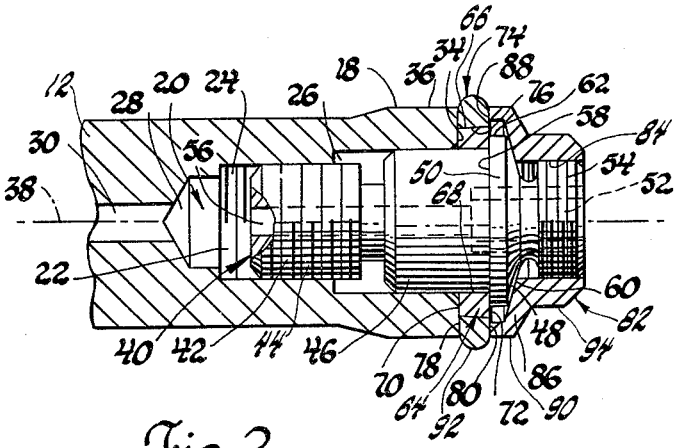
FIG. 2 is an enlarged view of the headed end of the burnishing tool of FIG. 1, as shown in cross-section and illustrating the invention in greater detail.

The burnishing tool 10 illustrated in FIG. 1 has a shank 12, one end 14 of which is adapted to be driven by a suitable tool drive means 16, only a part of that means being illustrated. The other end 18 of the tool shank 12 is formed with an open recess 20 which includes one part of a fastening means. The particular type of fastening means is a threaded arrangement and therefore the open recess 20 has threads 22 formed in recess intermediate portion 24. Recess 20 is also illustrated in FIG. 2 in greater detail as having a recess outer portion 26 of somewhat greater diameter than recess intermediate portion 24, and a recess inner portion 28 of somewhat lesser diameter than recess intermediate portion 24. A coolant passage 30 extends from the recess inner portion 28 toward the shank one end 14 to a suitable intermediate portion of the shank on which a coolant collar 32 is mounted. Passage 30 terminates within the collar with a cross passage portion opening to a mating opening formed in collar 32 to which a coolant tube or line may be suitably provided, as is well known in the art.

Shank other end 18 terminates in a shoulder 34. The outer diameter 36 of the shank adjacent the shoulder 34 is the maximum diameter of the tool shank, at least for a length equal to the depth of the bore to be burnished by the tool. The plane of shoulder 34 is preferably perpendicular to the axis 38 of the tool 10.

Figure 3:
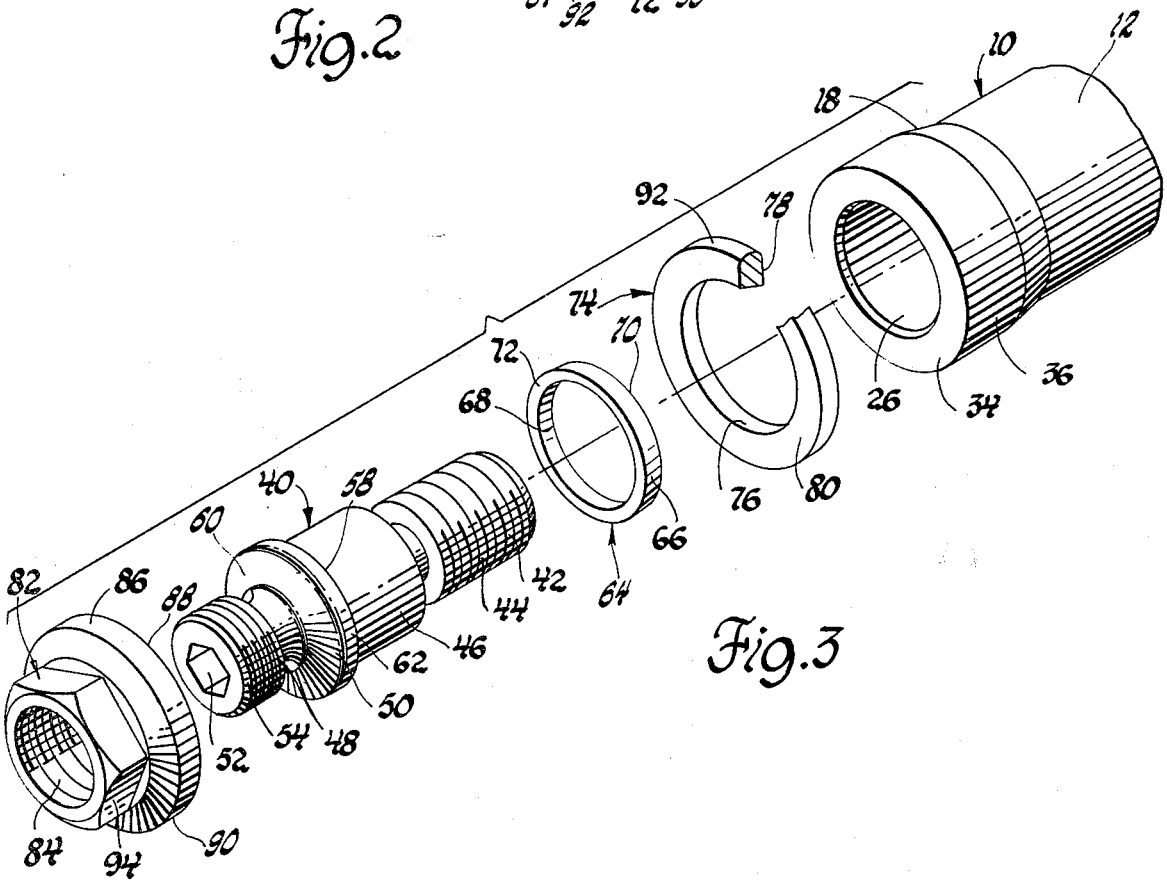
FIG. 3 is a perspective expanded view of the headed portion of the burnishing tool of FIG. 1 showing the manner in which the parts which make up the burnishing tool are assembled.

A draw bolt 40 is provided and is shown in detail in FIGS. 2 and 3. Draw bolt 40 has a bolt end 42 with threads 44 formed thereon. Threads 44 are mateable with threads 22 of the shank 12. The draw bolt has an intermediate section formed as a cylindrical section 46 which fits for axial movement within the recess outer portion 26 of recess 20. Draw bolt 40 has a headed end 48 formed to provide a flange 50 axially at one end of cylindrical section 46, and also formed to provide means for utilizing a drive tool to threadedly rotate the draw bolt 40 within recess 20. The drive tool means of the headed end is illustrated as taking the form of a drive tool recess 52. The recess 52 is hexagonal in cross-section so as to receive a suitable wrench for the purpose of driving the draw bolt. The bolt headed end 48 is also provided with external threads 54 on a portion thereof adjacent flange 50 and on the opposite side of that flange from cylindrical section 46. Draw bolt 40 has a coolant passage 56 extending axially therethrough so that the passage operates, when the draw bolt is assembled in the tool shank, to connect the recess inner portion 28 and the drive tool recess 52. It can therefore be seen that coolant can be supplied to the tool to flow through coolant passage 30, into recess inner portion 28 and then through coolant passage 56 and outwardly through drive tool recess 52 to the end of the burnishing tool. Flange 50 has one flange side 58 which is preferably perpendicular to the axis 38 of the burnishing tool 10, that axis being coincident with the axis of draw bolt 40. The other flange side 60 is preferably slightly tapered. The outer diameter 62 of flange 50 is the maximum outer diameter of the draw bolt 40. This maximum outer diameter 62 is less than the maximum outer diameter 36 of the shank other end 18.

An annular compression ring 64 is formed with an axially tapered outer peripheral surface 66, a cylindrical inner peripheral surface 68 and parallel sides 70 and 72. Compression ring 64 fits on the cylindrical section 46 of draw bolt 40 so that its side 72 is in engagement with the flange side 58 of the bolt. When assembled as shown in FIG. 2, the compression ring side 70 is in engagement with shoulder 34 of the shank other end 18. The outer diameter of the compression ring is preferably at least as large as the maximum outer diameter 62 of the draw bolt as found on flange 50, but is less than the outer diameter 36 of the shank other end 18.

A burnishing ring 74 is also provided. This ring is annular, having an inner diameter axially tapered surface 76 which mates with the outer diameter axially tapered surface 66 of compression ring 64. In the free or preassembled condition, the inner diameter axially tapered surface 76 of the burnishing ring 74 is sized relative to the axially tapered outer peripheral surface 66 of the compression ring so that the burnishing ring side 78 will engage the shoulder 34 of shank other end 18 axially before the side 70 of compression ring 64 does. The axial distance by which this preengagement occurs provides the adjustable distance through which the draw bolt can be tightened in expanding the burnishing ring as described below when an expanding burnishing ring is used. When a carbide or other non-expanding burnishing ring is used, the fit is preferably such that the sides 70 and 78 and shoulder 34 lie in substantially the same plane when the burnishing ring is fully tightened in place. The other side 80 of the burnishing ring 74 is sufficiently large at its inner diameter so that it is not engaged by side 58 of flange 50.

A jam nut 82 may also be provided. As illustrated in FIGS. 2 and 3, jam nut 82 has internal threads 84 which mate with threads 54 of the bolt headed end 48. One side of jam nut 82 is formed with a flange 86 having a tapered inner surface which mates with the tapered side 60 of the draw bolt flange 50. The outer portion of flange 86 extends axially so that it has an end surface 88 which engages surface 80 of the burnishing ring when the tool is assembled. The outer diameter 90 of flange 86 is the maximum outer diameter of the jam nut 82 and this diameter is less than the maximum outer diameter 92 of the burnishing ring 74. It is preferably substantially the same diameter as the maximum outer diameter 36 of the shank other end 18. Jam nut 82 is provided with a suitable head portion 94 adapted to receive a drive tool such as a wrench for tightening and loosening the jam nut.

In one embodiment of the invention, the compression ring 64 was brazed to the draw bolt 40 in the position illustrated in FIG. 2 and the outer peripheral surface 66 was then ground to a taper of approximately 4° included diameter after the assembly. The burnishing ring was likewise tapered to a matching 4° included diameter.

When further assembling the tool, the burnishing ring is installed over the compression ring after passing over the draw bolt end 42, the burnishing ring side 78 extending slightly beyond side 70 of the compression ring. The draw bolt and burnishing ring are then inserted in place so that the draw bolt is threaded into the recess 20 until the burnishing ring side 78 engages shoulder 34 of shank other end 18. At the point of such engagement but before the draw bolt has been further tightened, side 70 of the compression ring 64 will be slightly axially spaced from the shoulder 34. The axial spacing so provided provides the maximum adjustable distance through which the draw bolt can be tightened in expanding the burnishing ring when an expandable type burnishing ring is used. A suitable drive tool is then inserted in recess 52 of the draw bolt and the draw bolt is carefully tightened by threading bolt end 42 further into the threaded recess intermediate portion 24 of recess 20. This causes the compression ring 64 to move axially within the burnishing ring 74 and the tapered arrangement between these two rings will cause the burnishing ring to expand radially. The outer diameter of the burnishing ring may be measured while this is taking place so that the precise outer diameter of the burnishing ring is established in accordance with the amount of adjustment made by tightening the draw bolt. Once the precise desired outer diameter is obtained, the jam nut 82 is tightened in place so that it tightly holds the burnishing ring 74 in position by compressing it axially between the jam nut flange end 88 and shoulder 34. Therefore, the desired maximum outer diameter of the burnishing ring is maintained and the draw bolt is also locked against relative rotational movement within the shank 12. When a non-expandable burnishing ring such as one made of sintered carbide is used, the burnishing ring and the compression ring preferably are arranged so that the sides 70 and 78 are in a plane upon assembly. Thus the draw bolt is merely tightened into place as illustrated in FIG. 2 with both sides 70 and 78 engaging shoulder 34. The jam nut 82 is then tightened in position, holding the assembly in this position without exerting a substantial expanding force on the non-expandable burnishing ring.

The embodiments of the invention in which an exclusive property or privilege is claimed are defined as follows:

1. A burnishing tool comprising:

a tool shank having one end adapted to be driven by a suitable tool drive means and the other end formed with an open recess including one part of a fastening means, a draw bolt having an end in said open recess comprising another part of said fastening means and a headed end adapted to receive a draw bolt drive tool such as a wrench, a compression ring secured to and about said draw bolt intermediate said draw bolt ends and having an axially tapered outer peripheral surface tapering in the direction of said draw bolt threaded end, and a burnishing ring received about said draw bolt compression ring and axially engaging said tool shank other end, said burnishing ring having an outer diameter greater than the maximum outer diameter of at least the portion of said tool shank adjacent said tool shank other end and adapted to be inserted in a bore to be burnished, said burnishing ring outer diameter also being greater than the maximum outer diameter of said draw bolt, said burnishing ring having an inner diameter axially tapered surface mating with said axially tapered outer peripheral surface of said compression ring, said draw bolt when being tightened holding said compression ring tightly within said burnishing ring, said burnishing ring having a precise desired outer diameter for burnishing a bore.

2. An adjustable burnishing tool comprising:

a tool shank having one end adapted to be driven by a suitable tool drive means and the other end formed with a threaded open recess, a draw bolt having a threaded end threaded in said open recess and a headed end adapted to receive a draw bolt drive tool such as a wrench, a compression ring secured to and about said draw bolt intermediate said draw bolt ends and having an axially tapered outer peripheral surface tapering in the direction of said draw bolt threaded end, and a burnishing ring received about said draw bolt compression ring and axially engaging said tool shank other end, said burnishing ring having an outer diameter greater than the maximum outer diameter of at least the portion of said tool shank adjacent said tool shank other end and adapted to be inserted in a bore to be burnished, said burnishing ring outer diameter also being greater than the maximum outer diameter of said draw bolt, said burnishing ring having an inner diameter axially tapered surface mating with said axially tapered outer peripheral surface of said compression ring, said draw bolt when being tightened moving said compression ring axially within said burnishing ring until said burnishing ring has expanded to the precise desired outer diameter for burnishing a bore, said burnishing ring being made of a material having a sufficiently high modulus so that the burnishing ring does not reach the yield point within the adjustable distance through which the draw bolt can be tightened in expanding said burnishing ring.

3. An adjustable burnishing tool comprising:

a tool shank having one end adapted to be driven by a suitable tool drive means and the other end formed with a threaded open recess, a draw bolt having a threaded end threaded in said open recess and a headed end adapted to receive a draw bolt drive tool such as a wrench, a compression ring secured to and about said draw bolt intermediate said draw bolt ends and having an axially tapered outer peripheral surface tapering in the direction of said draw bolt threaded end, and a burnishing ring received about said draw bolt compression ring and axially engaging said tool shank other end, said burnishing ring having an outer diameter greater than the maximum outer diameter of at least the portion of said tool shank adjacent said tool shank other end and adapted to be inserted in a bore to be burnished, said burnishing ring outer diameter also being greater than the maximum outer diameter of said draw bolt, said burnishing ring having an inner diameter axially tapered surface mating with said axially tapered outer peripheral surface of said compression ring, said draw bolt when being tightened moving said compression ring axially within said burnishing ring until said burnishing ring has expanded to the precise desired outer diameter for burnishing a bore, said burnishing ring being made of a material having a sufficiently high modulus so that the burnishing ring does not reach the yield point within the adjustable distance through which the draw bolt can be tightened in expanding said burnishing ring, and a jam nut threaded on said draw bolt adjacent the headed end thereof and axially engaging said burnishing ring to lock said burnishing ring and said compression ring in position to hold the precise desired diameter of the burnishing ring, said jam nut having a maximum outer diameter less than the outer diameter of said burnishing ring.

4. A burnishing tool comprising:

a tool shank having one end adapted to be driven by a suitable tool drive means and the other end formed with an open recess including one part of a fastening means, a draw bolt having an end in said open recess comprising another part of said fastening means and a headed end adapted to receive a draw bolt drive tool such as a wrench, a compression ring secured to and about said draw bolt intermediate said draw bolt ends and having an axially tapered outer peripheral surface tapering in the direction of said draw bolt threaded end, and a burnishing ring received about said draw bolt compression ring and axially engaging said tool shank other end, said burnishing ring having an outer diameter greater than the maximum outer diameter of at least the portion of said tool shank adjacent said tool shank other end and adapted to be inserted in a bore to be burnished, said burnishing ring outer diameter also being greater than the maximum outer diameter of said draw bolt, said burnishing ring having an inner diameter exially tapered surface mating with said axially tapered outer peripheral surface of said compression ring, said draw bolt when being tightened holding said compression ring tightly within said burnishing ring, said burnishing ring having a precise desired outer diameter for burnishing a bore, said burnishing ring being made of carbide and adapted to be quickly removed and replaced as necessary due to wear or the requirement for a different burnishing ring diameter.

5. A burnishing tool comprising:

a tool shank having one end adapted to be driven by a suitable tool drive means and the other end formed with an open recess including one part of a fastening means, a draw bolt having an end in said open recess comprising another part of said fastening means and a headed end adapted to receive a draw bolt drive tool such as a wrench, a compression ring secured to and about said draw bolt intermediate said draw bolt ends and having an axially tapered outer peripheral surface tapering in the direction of said draw bolt threaded end, and a burnishing ring received about said draw bolt compression ring and axially engaging said tool shank other end, said burnishing ring having an outer diameter greater than the maximum outer diameter of at least the portion of said tool shank adjacent said tool shank other end and adapted to be inserted in a bore to be burnished, said burnishing ring outer diameter also being greater than the maximum outer diameter of said draw bolt, said burnishing ring having an inner diameter axially tapered surface mating with said axially tapered outer peripheral surface of said compression ring, said draw bolt when being tightened holding said compression ring tightly within said burnishing ring, said burnishing ring having a precise desired outer diameter for burnishing a bore, said burnishing ring being made of an expandable material and being expanded radially, as said draw bolt is tightened, by action of said compression ring axially tapered outer surface moving axially relative to said burnishing ring inner diameter axially tapered surface, until a desired burnishing ring outer diameter is obtained, the movement of said compression ring within said burnishing ring to expand said burnishing ring being limited to an amount which will not cause said burnishing ring to exceed the yield point of the burnishing ring material.

* * * * *